US006216367B1

(12) United States Patent
Tubbs

(10) Patent No.: US 6,216,367 B1
(45) Date of Patent: Apr. 17, 2001

(54) CLASSIFYING AND AIR-STRATIFYING GOLD SEPARATOR WITH INCLINED SEQUENTIAL CHUTE CONE ARRAY AND SIZE-CLASSIFYING SCREEN

(76) Inventor: George E. Tubbs, P.O. Box 98558, Des Moines, WA (US) 98198

( * ) Notice: Subject to any disclaimer, the term of this patent is extended or adjusted under 35 U.S.C. 154(b) by 0 days.

(21) Appl. No.: 08/677,042

(22) Filed: Jul. 8, 1996

(51) Int. Cl.[7] ..... B63C 11/00

(52) U.S. Cl. ..... 37/314; 209/486; 209/477; 209/474

(58) Field of Search ..... 37/314, 316, 321, 37/315, 318, 323, 195; 209/474, 475, 477, 485, 486, 502

(56) References Cited

U.S. PATENT DOCUMENTS

| | | | | |
|---|---|---|---|---|
| 360,713 | * | 4/1887 | Mendenhall | 37/314 |
| D. 377,182 | * | 1/1997 | Simpson | D15/147 |
| 540,997 | * | 6/1895 | Mendenhall | 37/314 |
| 609,624 | * | 8/1898 | Nelson | 209/485 X |
| 621,986 | * | 3/1899 | Williams | 209/485 |
| 769,886 | * | 9/1904 | Bollinger | 209/485 |
| 1,123,188 | * | 12/1914 | Green | 209/485 X |
| 1,505,735 | * | 8/1924 | Stebbins | 209/486 X |
| 1,588,102 | * | 6/1926 | Goody | 209/485 |
| 1,752,169 | * | 3/1930 | Goody | 209/485 X |
| 2,204,489 | * | 6/1940 | Gray | 209/485 X |
| 3,984,306 | * | 10/1976 | Sayles et al. | 209/474 X |
| 4,352,251 | * | 10/1982 | Sloan | 37/323 |
| 4,375,491 | * | 3/1983 | Honig | 209/485 X |
| 4,642,180 | * | 2/1987 | Kaufman | 209/475 X |
| 4,861,464 | * | 8/1989 | Zaltzman et al. | 209/486 X |

* cited by examiner

*Primary Examiner*—Victor Batson
(74) *Attorney, Agent, or Firm*—David L. Tingey

(57) ABSTRACT

A sluice comprising a series of sequential, interconnected chutes, each inverting a stratified slurry, discharges the slurry in each chute over a mesh screen in a subsequent chute and eventually out of the sluice, with each incremental stage designed to treat smaller matter. An array of cones is disposed on each chute bottom over which the slurry passes, each cone in the array having an opening oriented downwater and including a ridge over-hanging its opening also oriented downwater, such that heavy matter settling from the mineral matrix is drawn into the cone. Below the cone array is a perforated mat. Also below the array, beginning at the minor's moss mat and extending downwater, is a textured mat, typically with upstanding ribs transverse to the chute water flow that also tends to capture settling material. Below the miner's moss is provided a plurality of fluid nozzles, typically air holes in a network of tubes connected to an outside air compressor for lifting settled ore upward with ore of high specific gravity falling back and past the air nozzles, lighter gangue once again being returned to suspension in the slurry.

19 Claims, 5 Drawing Sheets

CLASSIFYING AND AIR-STRATIFYING GOLD SEPARATOR WITH INCLINED SEQUENTIAL CHUTE CONE ARRAY AND SIZE-CLASSIFYING SCREEN

BACKGROUND OF THE INVENTION

1. Field of the Invention

This invention relates generally to gold concentrators, including dredgers and high-bankers used in placer mining, and more particularly to a staged sluice for increment size classification and ore extraction.

2. Prior Art

The prior art in placer mining techniques discloses a large number of various devices sometimes termed collectors, separators, or extractors but all directed to extracting small amounts of gold from large volumes of mineral matter. It is known that the majority of gold in placer deposits is fine and very fine grain ore, the larger part of which is typically uncaptured in prior extraction techniques. Though all of the techniques seek to exploit the high specific gravity of gold, the difficulty of removing ore from the matrix in which it is found rests in overcoming detrimental effects of physical forces acting on such fine particles, such as suspension action in a slurry of the matrix in water and surface tension. These effects are exacerbated when fine ore competes with action of larger mineral aggregates, and separation and settling of ore due to its higher specific gravity is defeated. Therefore, the preliminary task before separation by specific gravity is first classification of the matrix and ore by size until ore and gangue can compete in terms of relative specific gravity with minimal effects, or at least non-dominating effects of other physical forces.

SUMMARY OF THE INVENTION

Ore with much higher density tends to settle out of suspension if allowed to compete with particles of similar size. Therefore, the present invention overcomes these difficulties in placer mining of very fine, or flour, gold generally by repeatedly classifying the gangue and ore mix by size until even the small minerals compete equally in size, thus allowing fine gold to settle out of suspension by its specific gravity higher than surrounding gangue into a scheme of traps that hold the ore for later removal. Repeated processing of the mix further classifies by size at an decreasingly smaller scale. Within each stage, ore and gangue in suspension are stratified by size within suspension with larger particles flowing above smaller particles. The larger particles are flushed away and out of the dredger with water flow while fine ore remains in suspension in lower stratification levels. The stratification is destroyed between stages along the dredger and restratified to enable separation and settling of ever finer ore with comparatively larger gangue being carried away in faster flowing upper levels of stratification, thus further concentrating the ore out of the gangue at each stage.

The primary object of the invention is therefore to provide a device to classify mineral matter by size preliminary to extracting fine gold ore from a slurry.

Another object is to provide incremental classifying in the device, at each incremental stage separating larger mineral matter from smaller mineral matter while allowing smaller matter to stratify and settle to collecting traps.

Another object is to provide a device that inverts stratified mineral matter between stages thereby destroying previously stratified matter, which matter has been previously classified by size in each stage, so that stratification of remaining mineral matter not settled out of suspension during a previous stage begins anew at each stage.

Another object is to provide a matrix of ore-capturing cones into which heavy mineral matter settles as lighter matter is carried away.

Another object is to provide a means to lift settled matter back into a less turbulent suspension in a second water flow below the cone matrix to further concentrate the ore and allow lighter matter to be carried away in suspension.

The approach to extract previously lost fine gold is to treat all size and weight material by incrementing. Optimum separation of smaller and heavier material in general has been compromised in approaches previous to the present concentrator by larger gangue that opposes selective settling by specific gravity and tends to keep fine material in suspension. It is imperative therefore in successfully capturing even fine grain ore to separate materials by size to allow similar size materials to be classified by weight. Thus, a series of size classification stages is employed within each stage, while weight classification is effected.

These objects are achieved in a sluice comprising a series of sequential, interconnected chutes. Between chutes is an inverter which inverts a stratified slurry such that an upper stratified slurry layer and lower stratified slurry layer in a given chute generally reverse position as the slurry is directed into a following chute, the slurry also reversing direction between the sections from downhill in the feed chute to uphill as it exits the inverter into the receiving chute entry end. In doing so, materials classified somewhat by size but still carried in the water, being stratified by size but not settled out of suspension, are inverted in the inverter, material of larger size being predominantly discharged first to a subsequent chute over a mesh screen and eventually out of the sluice faster than smaller material. Consequently, lighter materials carried characteristically lower in the slurry are turbulently deposited later and over larger materials with the larger materials carried away from off the screen, destroying the stratification of the remaining smaller mineral matter. Thus, each stage reclassify by size starting with remaining smaller mineral matter while larger materials move more quickly and out of the concentrator sluice.

With each incremental stage designed to treat smaller matter, the mesh of each chute screen is smaller than meshes of preceding chutes. Thus, each stage treats a material of smaller size defined by the screen mesh size eliminating size competition that tends to carry smaller heavier material in suspension with larger materials.

An array of cones is disposed on each chute bottom over which the slurry passes, adapted such that heavy matter settling from the mineral matrix is drawn into a cone of the array where it is trapped. Each cone in the array has an opening oriented downwater and includes a ridge overhanging its opening also oriented downwater. As the slurry flows rapidly over the ridges, a low pressure region develops below in the cone cavity. The majority of the water flows over the ridges from one cone to a successive cone carrying light and large material from chute to chute through and out of the dredger. A small portion of the water flowing close to the ridges is drawn into the respective low-pressure cavities. In doing so, small, heavy material—"fines"—falling under gravity out of the slurry mainstream are biased by the small portion of water into a low pressure cone cavity.

Below the cone array is a perforated mat, commonly known as miner's moss. Because heavy gold ore tends to fall immediately when the mineral matrix is deposited on the mesh screen, it is generally sufficient to locate the miner's moss at least on the chute upper portion under the mesh screen. Also below the array, beginning at the minor's moss mat and extending downwater, is a textured mat, typically with upstanding ribs transverse to the chute water flow that also tends to capture settling material.

Because ore and unwanted material inevitably settles in the perforated mat, or miner's moss, the material needs to be lifted from the moss to reenter the classification process. If left on the minor's moss, the settled material quickly covers or clogs it, leaving it ineffective, and the concentration process at that phase is defeated. Therefore, below the miner's moss is provided a plurality of fluid nozzles, typically air holes in a network of tubes connected to an outside air compressor. With air jetted from the holes upward into the minor's moss, settled mineral matter is lifted upward with ore of high specific gravity falling back and past the air nozzles and with lighter gangue once again returned to suspension in the slurry.

With such a classification system of sequential chutes and ore-trapping cone arrays, the chutes can be steeply inclined, even at 45 degrees or more. The steep incline not only quickly removes large gangue from the classification process allowing increased throughput of a mineral matrix, the more rapid-moving slurry inherent in a steeper incline actually enhances classification at the cone array as the flow over the cones further reduces pressure in the cone, better drawing heavy ore within.

The described ore concentrator can be employed as a high-banker or as a dredger. As a high-banker, a preliminary screen is typically placed inclined over a mixer box to reject grossly large matter deposited onto it before the mixer box feeds the first chute. Water is separately introduced into the mixer box usually by a pump drawing water from a nearby water body, such as a river.

As a dredger, the concentrator may be mounted on a river bank or floated on a river. Water and a mineral mix is pumped into a dredger hose and deposited into a mixer box. To assist the size classification process in the present invention, air is introduced into the dredger hose to assist in lifting the matrix and to begin size classification. That is, gangue pumped into the hose is eventually discharged into the concentrator, but within the hose the material is partially separated by size and stratified. Thus, when the material is discharged into the separator, competition between sizes is already somewhat reduced and the classification process in the separator is enhanced, requiring fewer classification stages.

If the chutes become tilted, either on the float or on a bank, settling material quickly concentrates in low areas, quickly covering and clogging collecting mats. It is therefore necessary to maintain the separator level so the full mat is employed and settling material is dispersed over a larger area. This is effected by hanging the separator by an adjustable-length chain.

DETAILED DESCRIPTION OF THE PREFERRED EMBODIMENT

Figure 1:
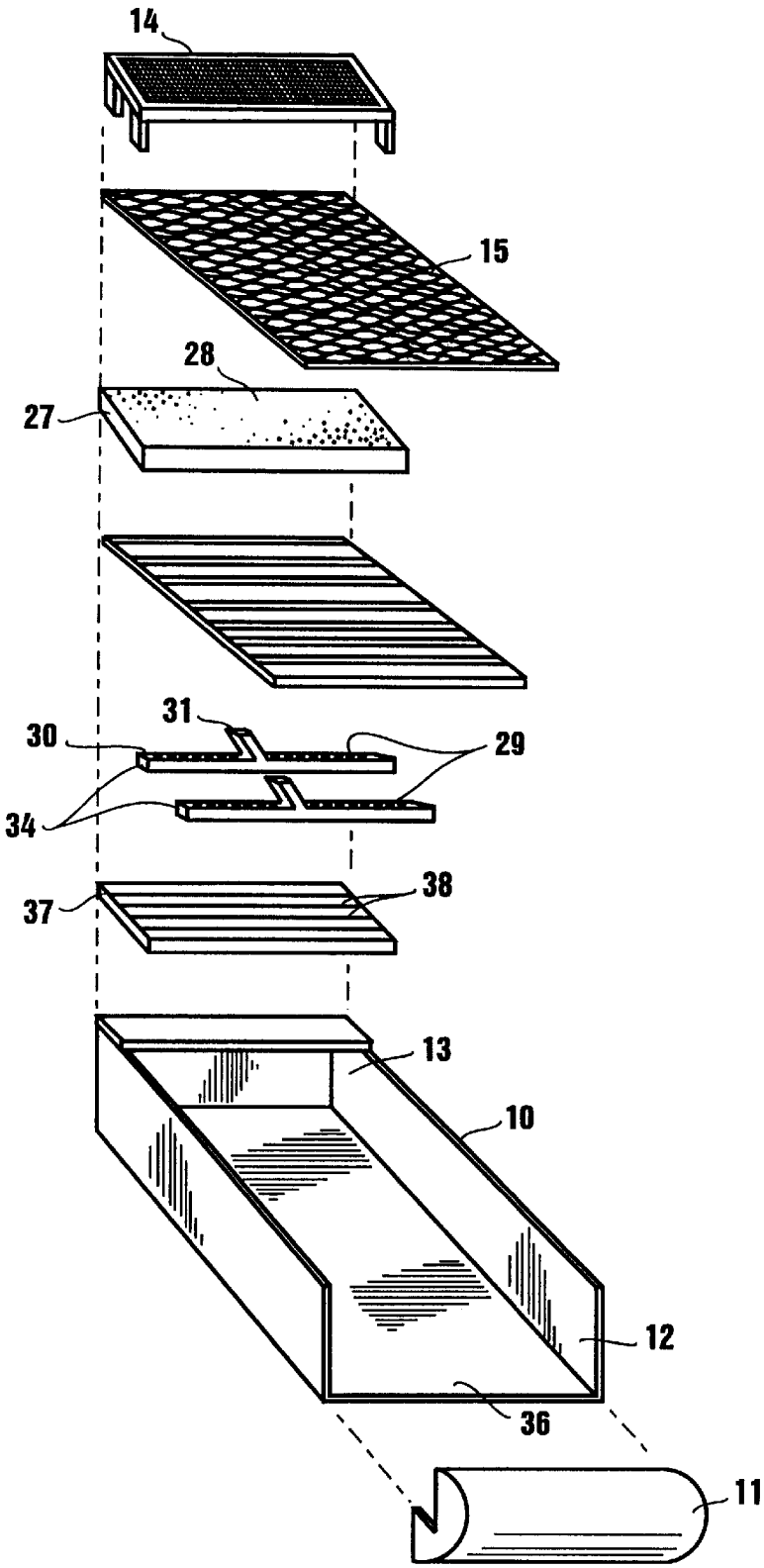
FIG. 1 is an exploded perspective view of a separator stage of the present invention.
Figure 2:
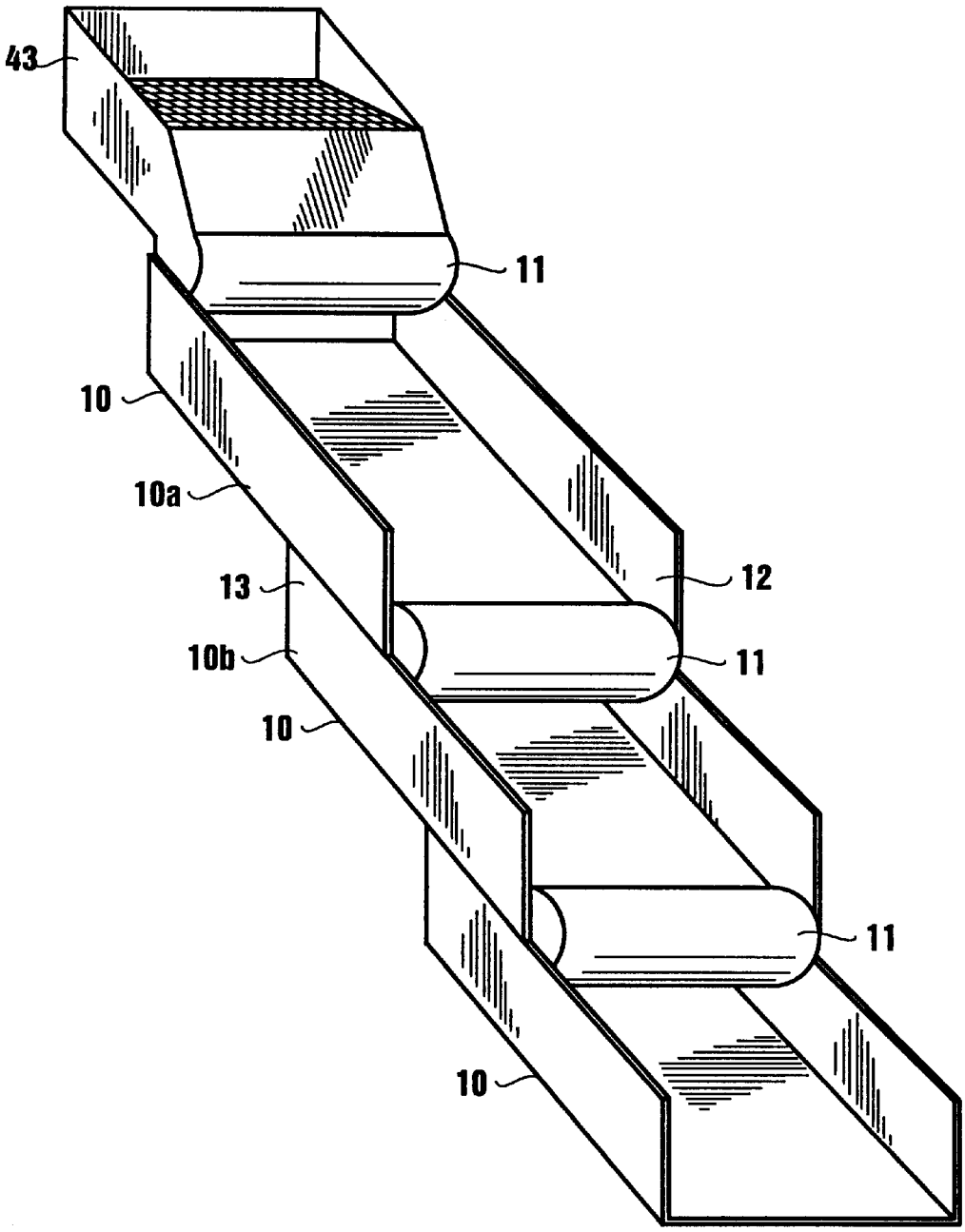
FIG. 2 is a perspective of view of several connected separator stages.
Figure 3:
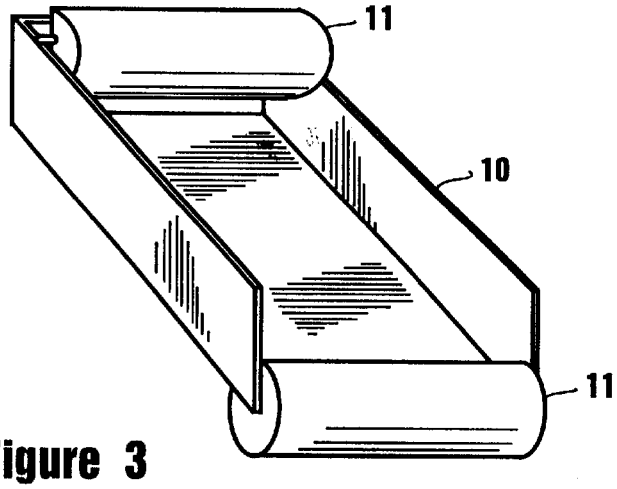
FIG. 3 is a chute of a stage with inverters shown at each end.
Figure 4:
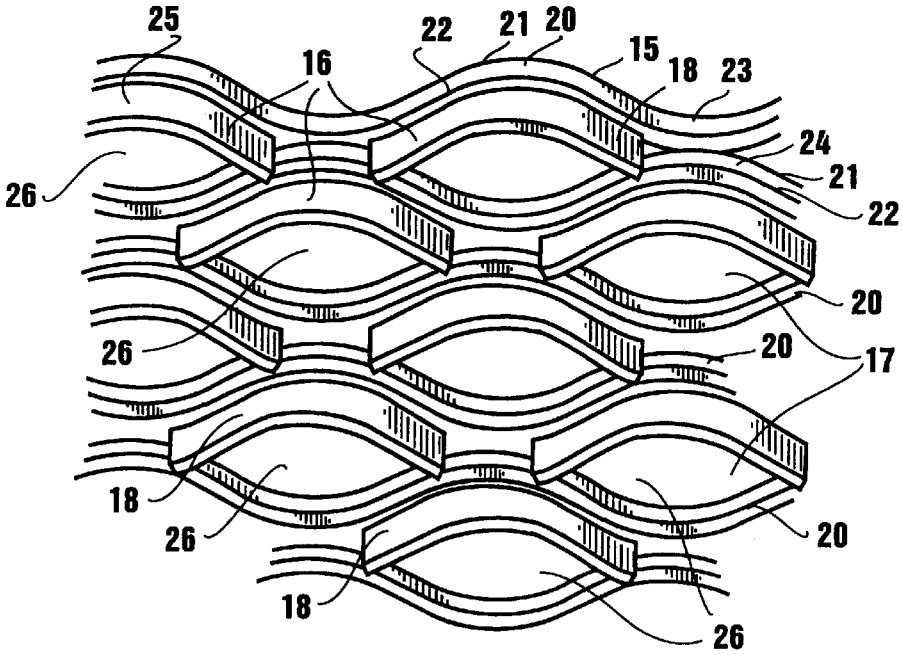
FIG. 4 is a perspective of a portion of the separator cone matrix.
Figure 5:
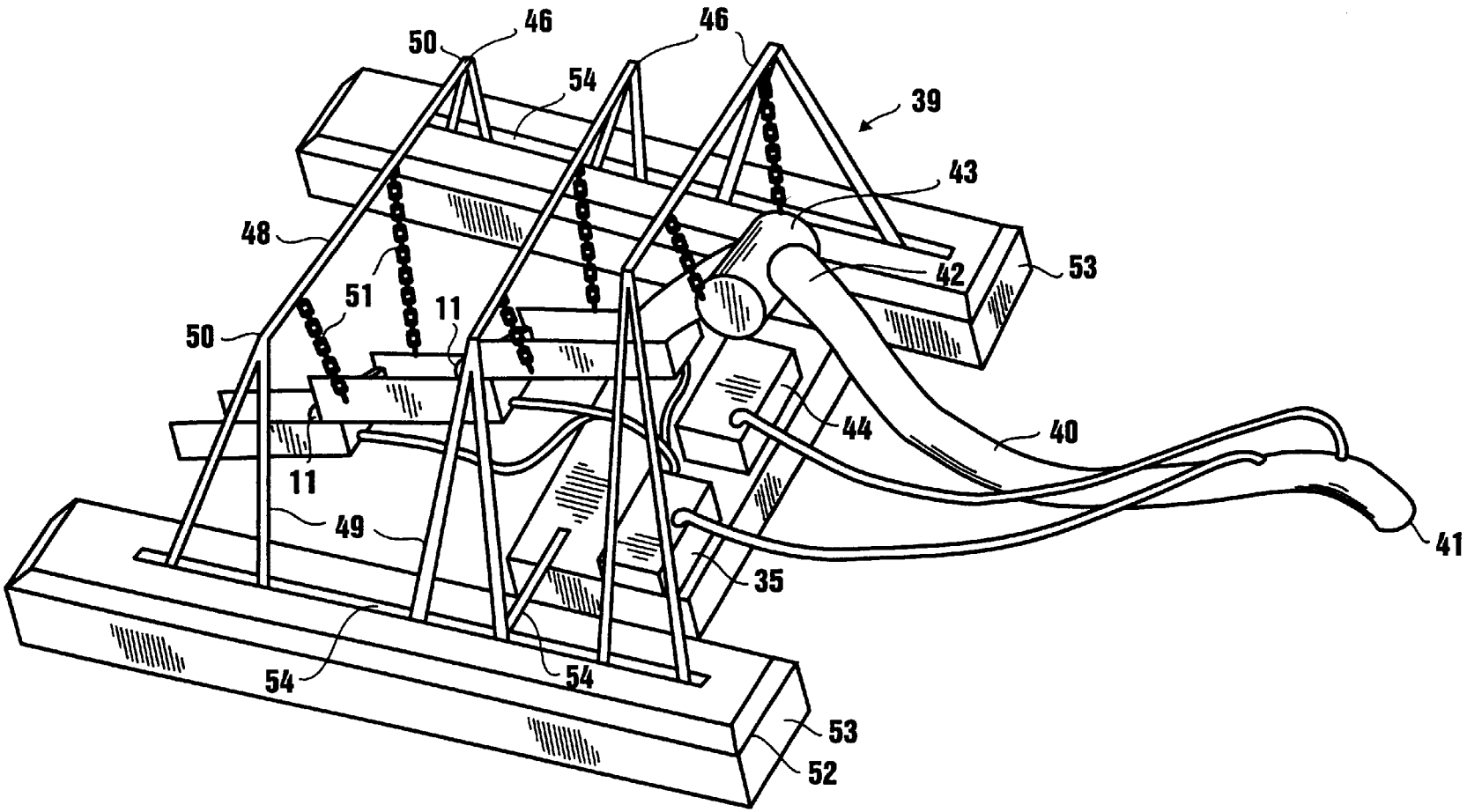
FIG. 5 is a pictorial view of a floating dredger comprising hanging separators.
Figure 6:
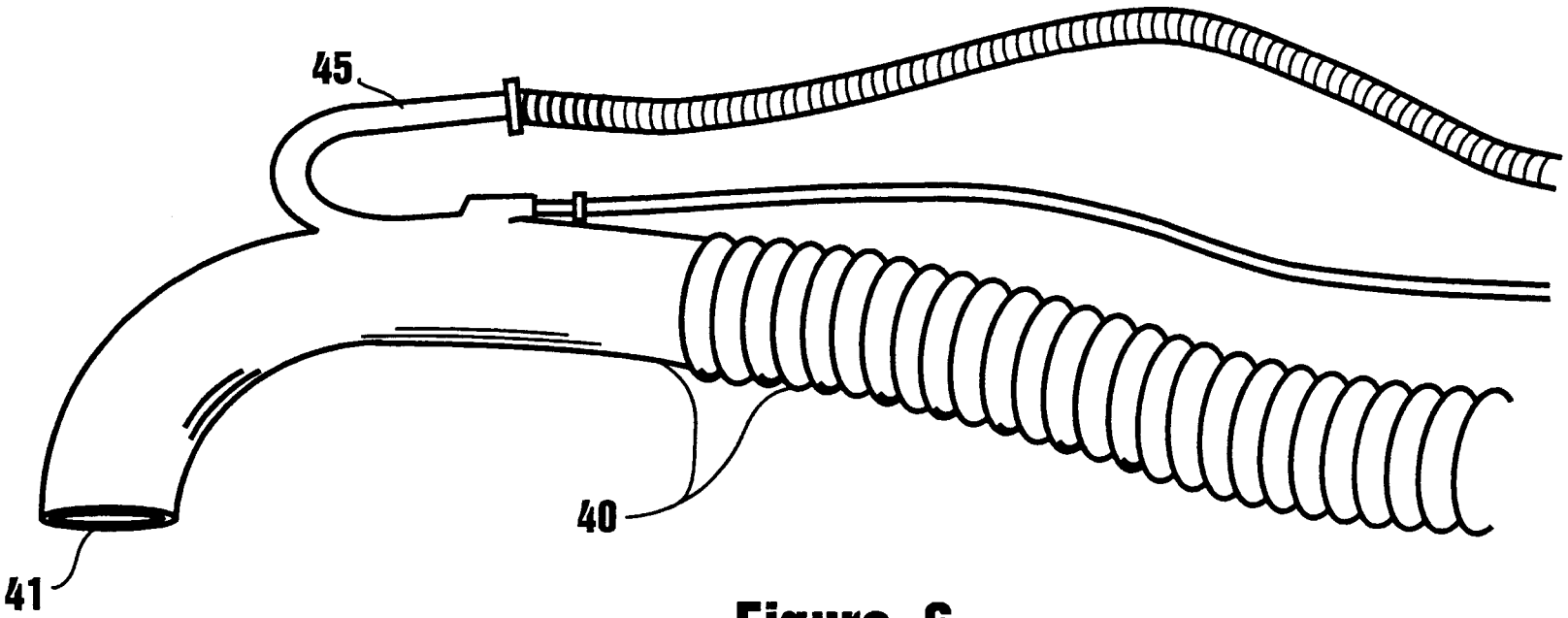
FIG. 6 is a dredger hose comprising a classifying air nozzle.

Referring to the drawings, the separator 1 of the present invention includes a sequential series of ore-separating chutes 10 within which ore is separated from gangue, each chute classifying ore and gangue by size at a finer scale than a preceding chute, generally known as incremental classification. Thus, the separator comprises at least two inclined chutes 10 and a curvilinear inverter 11 between each pair of chutes 10 directing a slurry of ore and gangue from a discharge end 12 of one chute 10*a* into the entry end 13 of a following chute 10*b*, inverting the slurry stratified in the size-classification action of the discharging chute. A size-classifying mesh screen 14 is located at the chute entry end 13 onto which the slurry is deposited, the screen of each subsequent chute having a finer mesh than preceding screens to further classify by size.

Below each mesh screen 14 is a cone array 15 comprising a plurality of cones 16 with an opening 17 to a cavity 26 directed downwater. Each cone 16 includes an overhanging ridge 18 over which the slurry rapidly passes for developing a low-pressure region in the cavity 26 below the ridge 18 and within the cone 16. Typically, the cone array 15 comprises a plurality of connected transverse ribs 20 in an approximately sinusoidal weave with inner and outer edges 21 and 22, the ribs 20 leaning downwater and staggered such that lows 23 of preceding rib outer edges 22 attach to highs 24 of successive rib inner edges 21. A rise 25 on the high 24 of each rib 20 extends each high 24 downwater therein forming the ridge 18, with the ridge 18 of preceding ribs 21 bridging the lows 23 and meeting the highs 24 of successive ribs 20, resulting in a repetitive pattern of cones with ridges 18 over formed cavities 26 thereunder.

A collecting mat 27 with a textured collecting surface 28 is positioned below the screen 14 and cone matrix 15 for collecting material passing through the screen 14 and settling out of the slurry into the cone matrix 15. The mat 27 typically is perforated, or equivalently comprises "miner's moss," at least under the mesh screen 14.

To lift gangue settled into the perforated mat 27 back into suspension, a plurality of nozzle holes 29 is provided in a nozzle 30 connected to a fluid source (not shown) under the perforated mat 27 for jetting fluid into the mat 27, adjusted with valve 31 such that heavy material falls immediately to the mat 27 while lighter gangue is lifted into suspension in a water slurry between the mat 27 and the cone matrix 15. Although the fluid may be pressurized water, typically compressed air is employed.

The nozzle 30 typically comprises a network of tubes 34 with several holes 29 connected to an air compressor 35. On the chute bottom 36, below the tubes 34 in the preferred embodiment, is a plurality of traps in a mat 37 under the perforated collecting mat 27 for capturing heavy ore. The trap mat 37 generally includes one or more strips 38 transverse in the chute 10 disposed to retain fine ore as slurry flows over the strips 38.

In combination with a dredger 39, a dredging hose 40 with an entry end 41 and a discharge end 42 is employed with its discharge end 42 disposed to discharge water into a separator mixer box 43 (or first chute). A water pump 44 is connected to the dredging hose 40 for pumping water into the entry end 41 and through the dredging hose 40 defining a hose water flow. A dredger hose nozzle 45 is connected to the dredger hose 40, and an air compressor 35 in fluid communication with the hose nozzle 45 feeds compressed air to the nozzle 45 for introducing compressed air into the hose water flow. The compressed air in the dredger hose 40 commences stratifying and classifying of gangue within the hose 40 before discharging it into the mixer box 43.

When the dredger 39 is floated, a vertical support frame 46 is provided which includes a frame support bar 48 supported by legs 49 on each end 50. The separator 1 is adjustably supported vertically on the support frame 46 to maintain the concentrator chutes 10 transversely level such that the slurry runs over the chutes 10 without preference from side-to-side on the transversely-level inclined chutes 10. Typically, the separator 1 is hung from the support bar 48 by a plurality of chains 51 adjusted in length to establish and maintain the chutes level. The support frame 46 is mounted on a float assembly 52, generally comprising one or more interlinked floats 53. Tracks 54 may be provided on the floats 53 aft to bow and port to starboard on which the support frame 46 may be secured to right the float level by appropriately positioning the separator 1.

Having described the invention, what is claimed is the following:

1. A gold separator adapted for separation of heavy ore from gangue, comprising an inclined sequential chute for receiving a slurry of mineral matter and water, and a size-classifying screen in the chute with a mesh onto which the slurry is received in the chute, an array of cones downwater of the mesh screen and disposed such that the slurry continues over and past the array and down the chute, the cones each comprising an opening directed downwater over which the slurry rapidly passes and adapted to develop a low-pressure region at the cone opening as a consequence of the slurry passing rapidly over and past the cone opening.

2. The gold separator of claim 1 further comprising a ridge overhanging each cone opening.

3. An array of cones for separating gold from gangue in a chute through which a slurry of water, ore and gangue passes, comprising a plurality of transverse ribs in an approximately sinusoidal weave with inner and outer edges, the ribs leaning downwater and staggered such that lows of preceding rib outer edges attach to highs of successive rib inner edges, and a rise on the high of each rib extending each high downwater therein forming a ridge, with the ridge of preceding ribs bridging the lows and joining the highs of successive ribs, resulting in a repetitive pattern of ridges over cavities formed thereunder adapted to develop a low-pressure region at the cavities as a consequence of a slurry passing rapidly over and past the cone cavities.

4. The gold separator of claim 1 further comprising a collecting mat with a textured collecting surface below the screen for collecting material passing through the screen and settling out of the water.

5. The gold separator of claim 4 in which said collecting mat is perforated and further comprising a plurality of nozzles for jetting fluid below the collecting surface of the perforated collecting mat such that settled material on the perforated collecting mat is lifted from the perforated collecting mat surface, and means for connecting the nozzles to a fluid source.

6. The gold separator of claim 5 further comprising means for adjusting fluid jet flow such that heavy material returns immediately to the mat collecting surface while lighter gangue is lifted into suspension in the water flow.

7. The gold separator of claim 5 with the nozzles disposed under the perforated collecting mat adapted to jet fluid through the perforated collecting mat.

8. The gold separator of claim 5 adapted to accommodate compressed air as the fluid.

9. The gold separator of claim 5 adapted to accommodate pressurized water as the fluid.

10. The gold separator of claim 5 wherein the plurality of nozzles comprises a network of tubes having a plurality of fluid discharge holes.

11. The gold separator of claim 5 further comprising a plurality of traps on the chute under the perforated collecting mat for capturing material falling through the perforated collecting mat.

12. The gold separator of claim 11 in which the plurality of traps comprises at least one strip transverse in the chute disposed to retain fine ore as water flows over the strips.

13. The gold separator of claim 1 in which the array of cones is directly underneath the screen.

14. A gold separator adapted to achieve size classification of gangue and separation of heavy ore from the classified gangue comprising an inclined sequential chute in a mixer box section for receiving a slurry of mineral matter and water, a size-classifying screen with a mesh onto which the slurry is received in the chute, an array of cones downwater of the mesh screen and disposed such that the slurry continues over and past the array and down the chute, the cones each comprising an opening directed downwater over which the slurry rapidly passes and adapted to develop a low-pressure region at the cone opening as a consequence of the slurry passing rapidly over and past the cone opening, a perforated collecting mat with a textured collecting surface below the screen for collecting material passing through the screen and settling out of the water, a plurality of nozzles under the perforated collecting mat for jetting fluid from below into the perforated collecting mat such that settled material on the mat is lifted from the mat surface, at least one strip under the plurality of nozzles transverse in the chute disposed to retain fine ore as water flows over the at least one strip, and means for connecting the nozzles to a source of fluid.

15. The gold separator of claim 14 in which the cone array comprises a plurality of transverse ribs in an approximately sinusoidal weave with inner and outer edges, the ribs leaning downwater and staggered such that lows of preceding rib outer edges attach to highs of successive rib inner edges, and a rise on the high of each rib extending each high downwater therein forming a ridge, with the ridge of preceding ribs bridging the lows and joining the highs of successive ribs, resulting in a repetitive pattern of ridges over cavities formed thereunder.

16. A gold separator adapted for separation of heavy ore from gangue in a sluice by employing increment size classification stages comprising a series of sequential, inclined chutes in successive fluid communication, each chute defining a size-classification stage wherein an inclined chute of a given stage separates and removes gangue from ore mixed in gangue of size larger than is separated and removed in an inclined chute of a succeeding stage, and an inverter between chutes disposed to route water from an exit end of a preceding chute to an entry end of a subsequent receiving chute.

17. The gold separator of claim 16 in which the inverter is curvilinear and adapted to invert a wash of stratified mineral matter in suspension in water as the inverter routes the wash to a subsequent chute such that larger material stratified above smaller material is deposited first into the subsequent receiving chute and carried downwater before lighter material enters the receiving chute, thereby further classifying the material, and such that stratification is destroyed within the remaining wash in preparation for reclassification within the receiving chute.

18. The gold separator of claim 16 further including a cone array within each chute, comprising a size-classifying screen within each chute at each chute entry end onto which the slurry is received wherein each screen in a successive chute has a smaller mesh than preceding screens, a plurality of transverse ribs in an approximately sinusoidal weave with inner and outer edges, the ribs leaning downwater and staggered such that lows of preceding ribs outer edges attach to highs of successive rib inner edges, a rise on the high of each rib extending each high downwater therein forming the ridge, with the ridge of preceding ribs bridging the lows and joining the highs of successive ribs, resulting in a repetitive pattern of ridges over cavities formed thereunder.

19. A method of separating gold ore from gangue in placer mining employing a mixture of water, ore and gangue, comprising the steps of depositing the mixture in a chute;

classifying the mixture by size within the chute to exclude gangue larger than ore;

separating ore from the remaining gangue within the chute;

destroying any size classification within the mixture and depositing the mixture less separated ore into a subsequent chute adapted to reclassify the mixture by size prior to separating ore from the remaining gangue, the reclassifying step comprising separating and removing gangue in said subsequent chute from ore mixed in gangue of size smaller than was separated and removed in the preceding chute;

jetting fluid into the collecting mat such that material is lifted from the mat for further ore separation, and providing a size-classifying screen within each chute at each chute entry end onto which the slurry is received wherein each screen in a successive chute has a smaller mesh than preceding screens.

* * * * *